US006918512B2

(12) United States Patent
Kondoh

(10) Patent No.: US 6,918,512 B2
(45) Date of Patent: Jul. 19, 2005

(54) REFILLABLE SPRAY CONTAINER

(75) Inventor: Masahito Kondoh, Toyokawa (JP)

(73) Assignee: Fukugo Shizai Co., Ltd. (JP)

( * ) Notice: Subject to any disclaimer, the term of this patent is extended or adjusted under 35 U.S.C. 154(b) by 194 days.

(21) Appl. No.: 10/428,021

(22) Filed: May 2, 2003

(65) Prior Publication Data

US 2003/0234263 A1 Dec. 25, 2003

(30) Foreign Application Priority Data

Jun. 24, 2002 (JP) ..... 2002-182517

(51) Int. Cl.[7] ..... B67B 5/00
(52) U.S. Cl. ..... 222/153.09; 222/402.1
(58) Field of Search ..... 222/153.09, 402.1–402

(56) References Cited

U.S. PATENT DOCUMENTS 2,815,889 A * 12/1957 Stetz ..... 222/402.2
3,417,904 A * 12/1968 Sands ..... 222/95
5,179,980 A * 1/1993 Hubner et al. ..... 139/450
5,636,769 A * 6/1997 Willingham ..... 222/400.7

FOREIGN PATENT DOCUMENTS

| | | |
|---|---|---|
| WO | WO 89/02317 | 3/1989 |
| WO | WO 96/18466 | 6/1996 |
| WO | WO 99/03778 | 1/1999 |

* cited by examiner

*Primary Examiner*—Michael Mar
*Assistant Examiner*—Patrick Buechner
(74) *Attorney, Agent, or Firm*—Steptoe & Johnson LLP

(57) ABSTRACT

A refillable spray container including a container main body and a cap with a nozzle, wherein a tubular mouth piece provided with engaging projections is mounted to a mouth portion of the container main body, and wherein a cap provided with a guide groove that engages with the engaging projections in a bayonet style is attached to the mouth piece in a freely attachable/detachable manner. The cap includes a brim portion for sealing a top surface portion of the mouth piece and a cylindrical portion that is inserted into the interior of the mouth piece, wherein a guide groove is formed on an outer periphery of the cylindrical portion.

3 Claims, 7 Drawing Sheets

REFILLABLE SPRAY CONTAINER

BACKGROUND OF THE INVENTION

1. Field of the Invention

The present invention relates to a refillable spray container of superior economical efficiency with which it is possible to refill spraying liquid and pressurized gas in a safe and simple manner.

2. Description of the Prior Art

Spray containers are being widely employed up to now for various purposes such as cleaning sprays, insect repellant sprays or painting sprays. However, all of those conventional spray containers were of disposable type and thus ran counter to demands for resource saving and reduction of wastes. Moreover, since LPG gas was employed as pressurized gas, anxieties also existed in that LPG gas discharged into air would do harm to the environment.

It has accordingly been suggested for a spray container of a type in which the spray containers are reused upon refilling spent spraying liquid or pressurized gas (International Laid-Open Publication Number WO89/02317). However, drawbacks were presented in that since the container construction of such type was a special one and since an apparatus for supplying gas or the like was also of massive structure, such a container lacked in versatility and was also expensive. It has thus been desired for developments of refillable spray containers of novel type with which it is possible to refill pressurized gas or the like in a safe and simple manner by utilizing can-typed containers that are conventionally manufactured in large volumes and at low costs.

SUMMARY OF THE INVENTION

The present invention has been made with the aim of solving the above-mentioned conventional problems and of providing a refillable spray container with which it is possible to refill spraying liquid and pressurized gas in a safe and simple manner, with which container main bodies and caps may be reused without either of these being wasted and which is of superior economical efficiency upon achieving satisfactory resource saving and reduction of wastes.

The refillable spray container according to the present invention that has been made for solving the above subject comprises a container main body and a cap with a nozzle, wherein a tubular mouth piece provided with engaging projections is mounted to a mouth portion of the container main body, and wherein a cap provided with a guide groove that engages with the engaging projections in a bayonet style is attached to the mouth piece in a freely attachable/detachable manner.

It should be noted that the cap comprises a brim portion for sealing a top surface portion of the mouth piece and a cylindrical portion that is inserted into the interior of the mouth piece, wherein a guide groove is formed on an outer periphery of the cylindrical portion.

The guide groove may be comprised with a clamping step portion for clamping the engaging projections, an intermediate step portion located at a position lower than the clamping step portion for preventing pop-up of the cap, and a releasing portion for detaching the engaging projections.

An O-ring for sealing the mouth piece may be attached to a lower surface side of the brim portion, wherein one or more than two degasifying longitudinal grooves are formed at a groove portion for accumulating the O-ring.

Moreover, compressed air may be filled as pressurized gas so that an environmental-friendly product may be provided in such a case.

Since the refillable spray container of the present invention is arranged in the above-described manner, the cap that is in engagement in bayonet style is rotated to be simply detached from the container main body after used up, and upon repeatedly attaching the cap thereto after filling spraying liquid through the mouth portion and filling pressurized gas (compressed air) from the nozzle side in a known manner, it is possible to reuse the same as a renewed spray. Moreover, since the guide groove that engages with the engaging projections in bayonet style is provided with the intermediate step portion located at a position lower than the clamping step portion for preventing pop-up of the cap, it is possible to reliably prevent pop-up of the cap through internal pressure when opening the cap. Further, since the O-ring for sealing the mouth piece is attached to the lower surface side of the brim portion, it is also possible to reliably prevent the O-ring from falling off the groove portion.

DESCRIPTION OF THE PREFERRED EMBODIMENT

Figure 1:
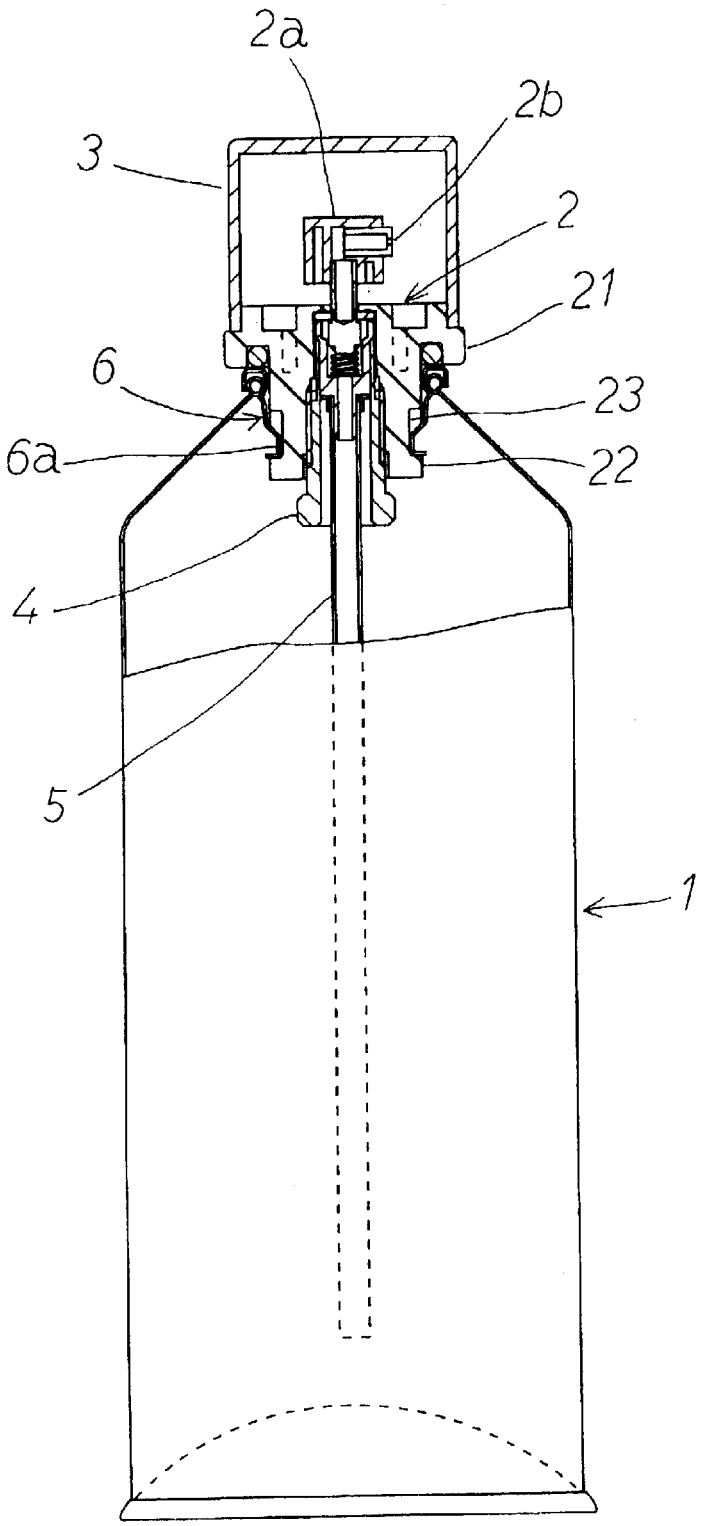
FIG. 1 is a partially notched front view illustrating one embodiment of the present invention.

A preferred embodiment of the present invention will now be illustrated while referring to the drawings.

In FIG. 1, 1 denotes a container main body, 2 a cap with a nozzle 2*a*, and 3 a lid body. 4 denotes a nut and 5 a dip tube, and it is basically of identical structure as that of a conventional spray container in view of the point that spraying liquid is sprayed through a discharge outlet 2*b* by means of pressurized gas when the lid body 3 is detached and the nozzle 2*a* is pressed.

Figure 2:
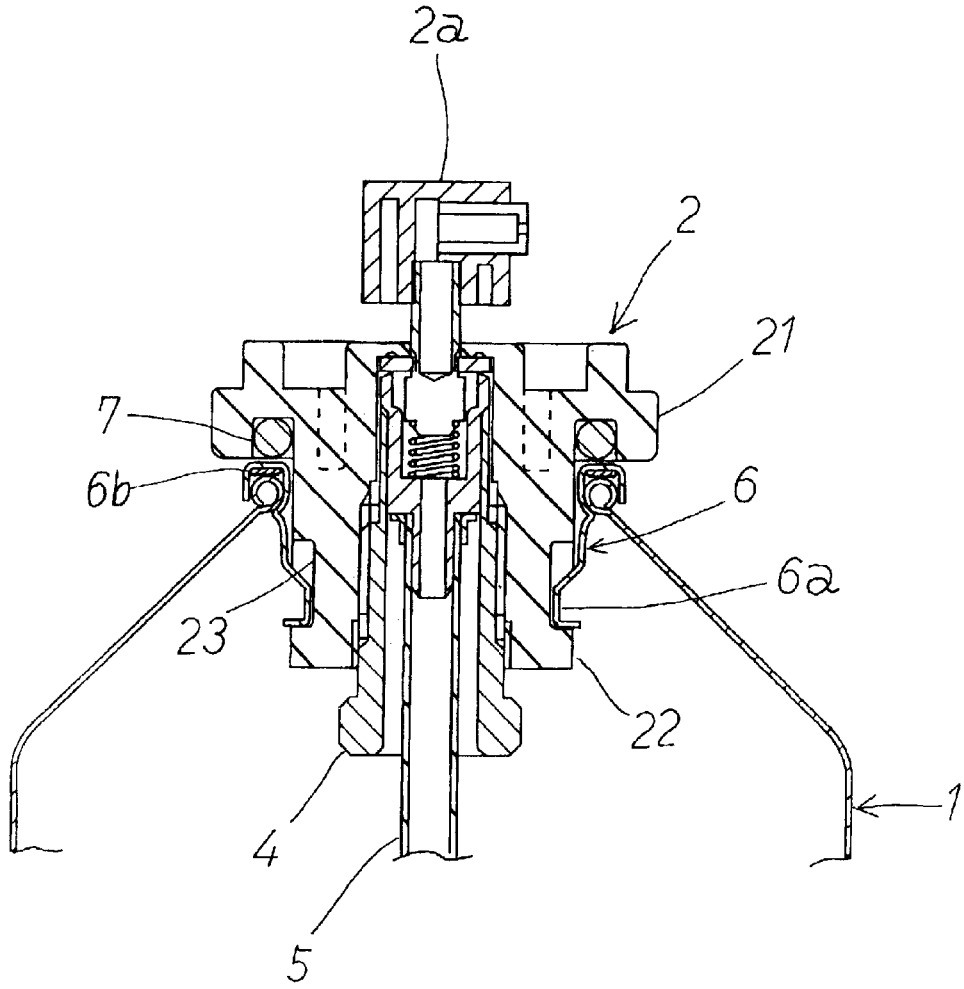
FIG. 2 is a cross-sectional view of a main part of FIG. 1.
Figure 3:
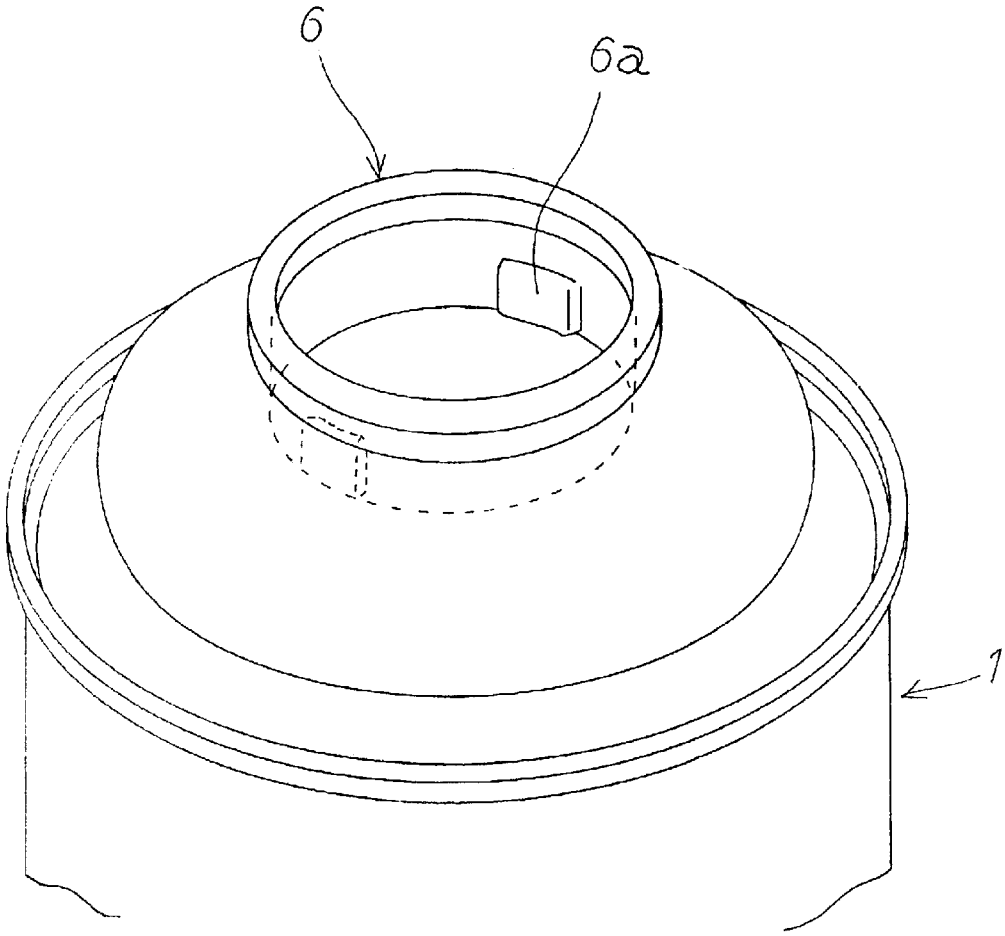
FIG. 3 is a perspective view illustrating a mouth piece mounted to a mouth portion of the container main body.

As illustrated in FIG. 2, the present invention is arranged in that a tubular mouth piece 6 provided with engaging projections 6*a* is mounted to a mouth portion of the container main body 1 with a packing 6*b* being interposed between. In the illustrated case, two of the engaging projections 6*a* are provided on a diagonal line as illustrated in FIG. 3. The cap 2 provided with a guide groove 23 that engages with the engaging projections 6*a* in bayonet style is attached to the mouth piece 6 in a freely attachable/detachable manner. It should be noted that a conventional spray can that is manufactured in large volumes and at low costs may be employed entirely as the container main body 1.

In this manner, by engaging the engaging projections 6*a* provided at the mouth piece 6 with the guide groove 23 provided at the cap 2 in bayonet style in the present invention, the cap 2 is arranged to be freely attachable/detachable so as to enable easy refill of spraying liquid and pressurized gas and thus to enable reuse the container main body 1 and the cap 2.

Figure 4:
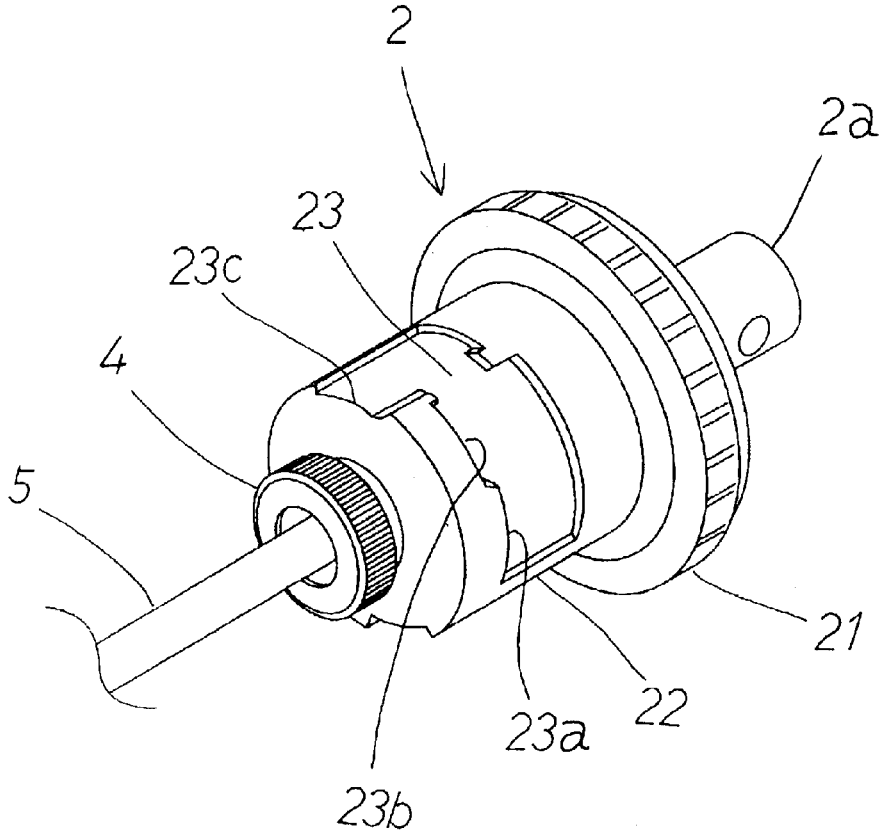
FIG. 4 is a perspective view illustrating a cap.

Discussing this in more details, the cap 2 comprises a brim portion 21 for tightly sealing a top surface portion of the mouth piece 6, and a cylindrical portion 22 that is inserted in the interior of the mouth piece 6, and the guide groove 23 is formed on an outer periphery of the cylindrical portion 22 as illustrated in FIG. 4.

Figure 5:
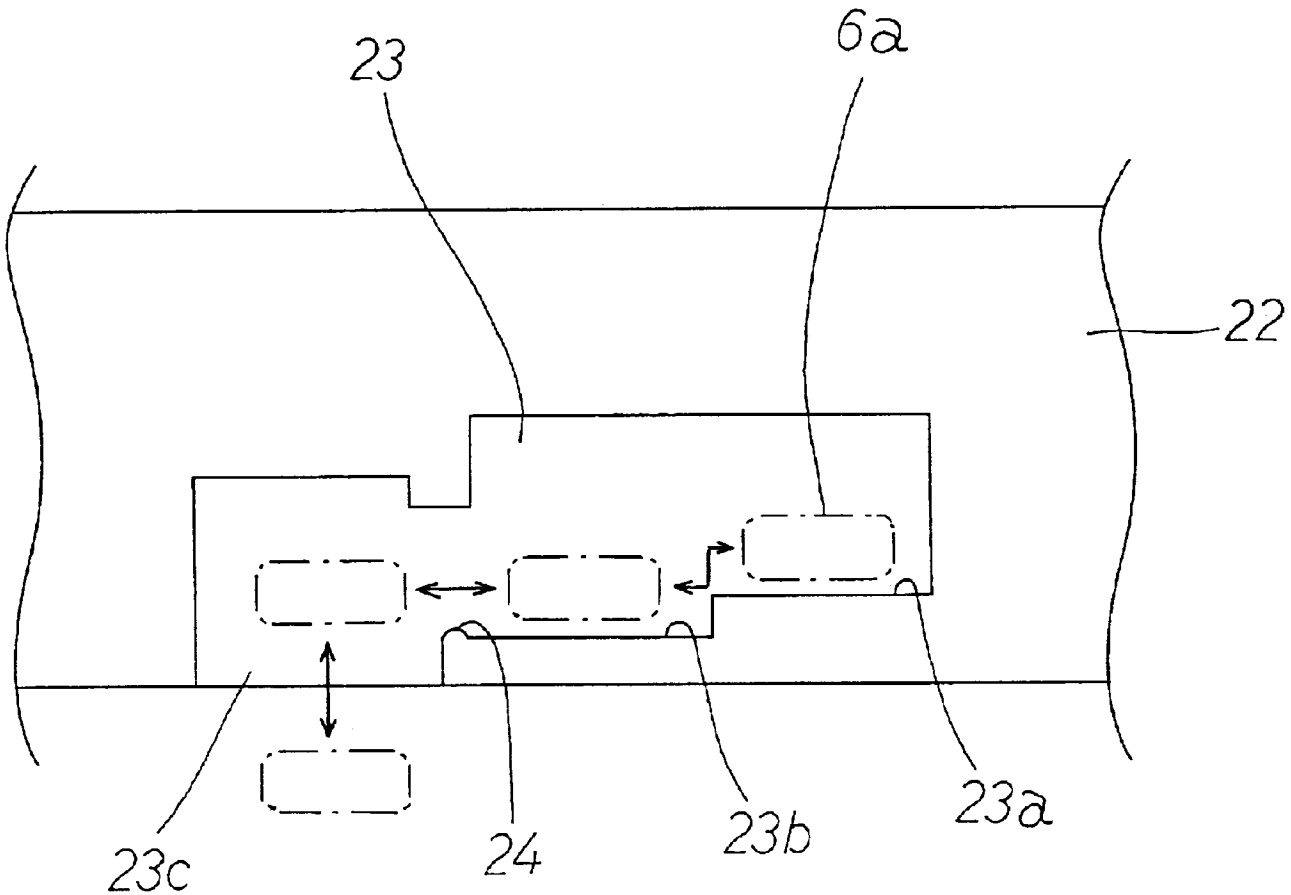
FIG. 5 is an exploded view of a guide groove.

As illustrated in FIG. 5, the guide groove 23 comprises a clamping step portion 23*a* for clamping the engaging projections 6*a,* an intermediate step portion 23*b* located at a position lower than the clamping step portion 23*a* for preventing pop-up of the cap, and a releasing portion 23*c* for detaching the engaging projections 6*a*. It should be noted that 24 denotes a projection for applying a sense of moderation to movements when the engaging projections 6*a* are moved to the releasing portion 23*c*.

In this manner, by the provision of the intermediate step portion 23*b* located at a position lower than the clamping step portion 23*a* for preventing pop-up of the cap at the guide groove 23 that engages with the engaging projections 6*a* in bayonet style, it is possible to reliably prevent pop-up of the cap 2 through internal pressure when opening the cap 2.

More particularly, when the cap 2 is rotated and opened, the engaging projections 6*a* will not move directly from the clamping step portion 23*a* to the releasing portion 23*c* but first move to the intermediate step portion 23*b*. Since this intermediate step portion 23*b* is located to be lower than the clamping step portion 23*a,* the cap 2 will here be in a somewhat lifted condition, and gas residing in the container main body will be discharged to the exterior. At this time, the cap 2 tries to pop-up in the outward direction while it is impossible to release the engagement with the guide groove 23 since the cap is hooked up at the intermediate step portion 23*b*. It is consequently possible to reliably prevent pop-up of the cap 2 through internal pressure when opening the cap 2.

Thereafter, when the cap 2 is further rotated to get over the projection 24 such that the engaging projections 6*a* are rotated to a position of the releasing portion 23*c,* it is of course possible to easily detach the cap 2.

Figure 6:
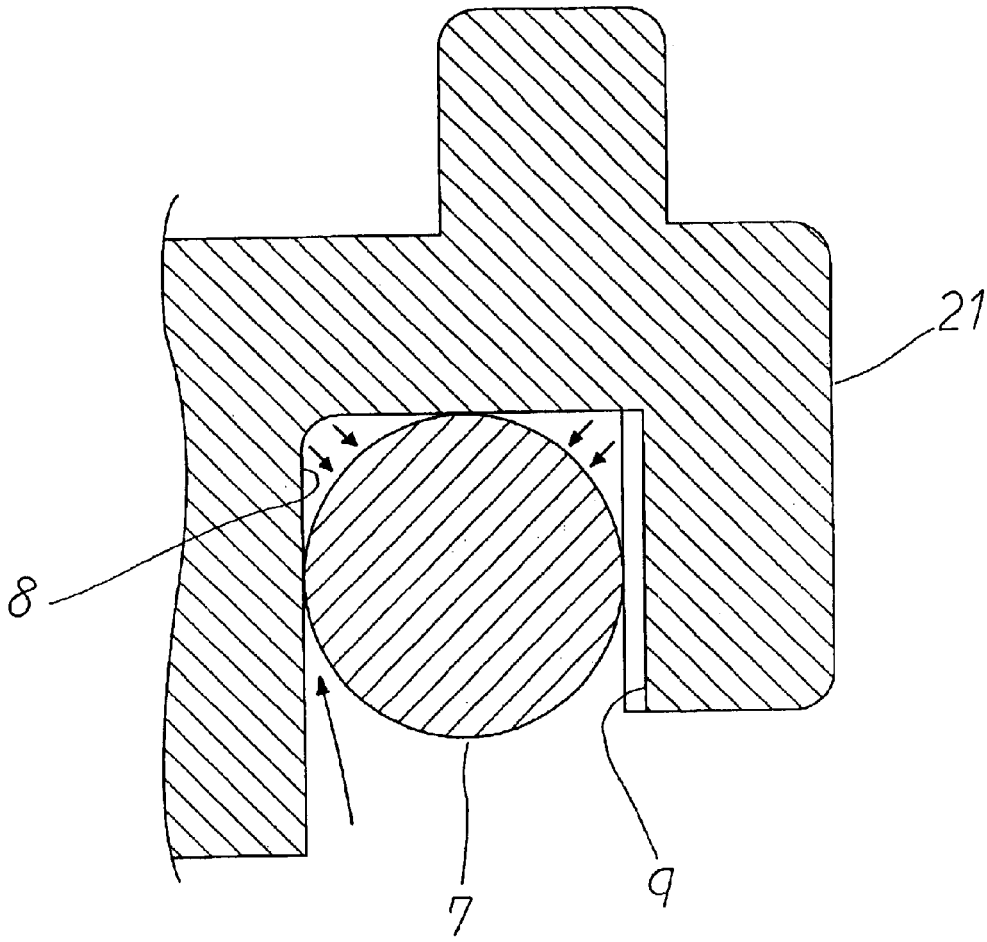
FIG. 6 is a cross-sectional view illustrating a condition of attaching an O-ring.
Figure 7:
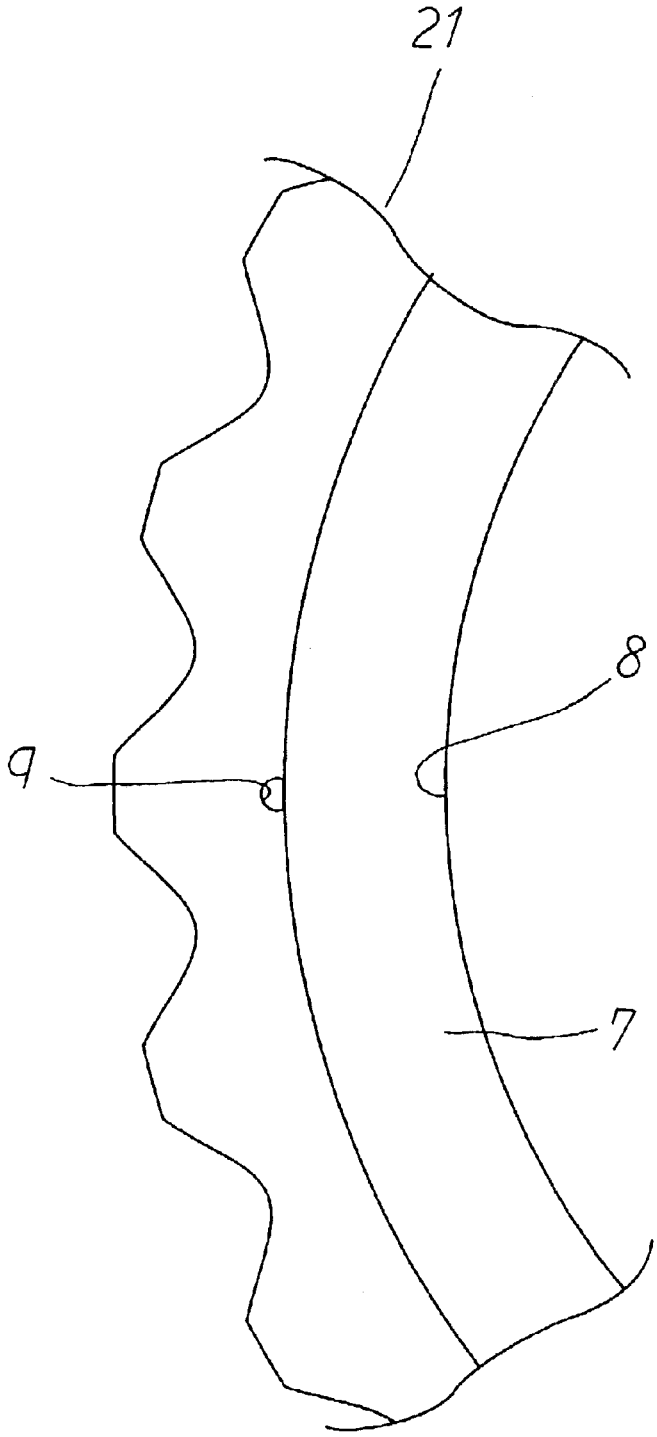
FIG. 7 is a plan view illustrating a condition of attaching the O-ring.

As illustrated in FIGS. 6 and 7, an O-ring 7 for sealing the mouth piece 6 is attached to a lower surface side of the brim portion 21, wherein one or more than two degasifying longitudinal grooves 9 are formed at a groove portion 8 for accumulating the O-ring 7. As already mentioned, a phenomenon is generated in that when detaching the cap 2 and gas residing in the container main body is discharged to the exterior, force acts to press the O-ring 7 downward so that the O-ring 7 comes off the groove portion 8 (see arrow in FIG. 6). Accordingly, by forming the degasifying longitudinal grooves 9, gas pressure is allowed to be discharged to the exterior through the degasifying longitudinal grooves 9 and thus to reliably prevent the O-ring 7 from coming off the groove portion 8.

As explained so far, since the present invention is arranged in that a tubular mouth piece 6 provided with engaging projections 6*a* is mounted to a mouth portion of a container main body 1 and in that a cap 2 provided with a guide groove 23 that engages with the engaging projections 6*a* in bayonet style is attached to the mouth piece 6 in a freely attachable/detachable manner, the cap 2 in bayonet style engagement is rotated to be simply detached from the container main body 1 after used up, and upon repeatedly attaching the cap thereto after filling spraying liquid through the mouth portion and filling pressurized gas (compressed air) from the nozzle 2*a* side in a known manner, it is possible to reuse the spray as a renewed spray.

Moreover, since the guide groove 23 that engages with the engaging projections 6*a* in bayonet style is provided with the intermediate step portion 23*b* located at a position lower than the clamping step portion 23*a* for preventing pop-up of the cap, it is possible to reliably prevent popup of the cap 2 through internal pressure when opening the cap 2. Further, since an O-ring 7 for sealing a mouth piece 6 is attached to a lower surface side of a brim portion 21, it is also possible to reliably prevent the O-ring 7 from falling off a groove portion 8.

Moreover, since compressed air is employed in the present invention instead of conventional LPG gas as for the pressurized gas, the environment will not be harmed at all when such gas is discharged from the container so that it is possible to provide an environment-friendly product.

As it is apparent from the above explanations, the present invention is of superior economical efficiency since it is possible to refill spraying liquid and pressurized gas in a safe and simple manner, to reuse the container main body and the cap without wasting either of them, and to achieve resource saving and reduction of wastes in a satisfactory manner.

What is claimed is:

1. A refillable spray container, comprising a container main body having a mouth portion and a cap with a nozzle, said mouth portion comprising a tublar mouth piece having engaging projections, and the cap comprising a guide groove for releasable bayonet engagment with the engaging projections, wherein the guide groove comprises a clamping step portion for clamping the engaging projections, an intermediate step portion located at a position lower then the clamping step portion for preventing pop-up of the cap, and a releasing portion for detaching the engaging projections.

2. The refillable spray container as claimed in claim 1, further comprising an O-ring and a groove portion for seating the O-ring, wherein the cap comprises a brim portion having a lower surface side for sealing a top surface portion of the mouth portion, and said O-ring is for sealing the mouth piece and is attached to the lower surface side of the brim portion, the groove portion comprising one or more then two degasifying longitudinal grooves.

3. The refillable spray container as claimed in claim 1, wherein said spray container holds compressed air.

* * * * *